United States Patent [19]

Soth et al.

[11] Patent Number: 4,659,014

[45] Date of Patent: Apr. 21, 1987

[54] ULTRASONIC SPRAY NOZZLE AND METHOD

[75] Inventors: J. Michael Soth; James R. Klemm, both of Des Moines, Iowa

[73] Assignee: Delavan Corporation, West Des Moines, Iowa

[21] Appl. No.: 772,753

[22] Filed: Sep. 5, 1985

[51] Int. Cl.[4] ..... B05B 1/08

[52] U.S. Cl. ..... 239/102.2; 239/4; 310/311; 310/317

[58] Field of Search ..... 239/102.4, 102.2, 311, 239/317; 310/316, 317, 311

[56] References Cited

U.S. PATENT DOCUMENTS

| | | | |
|---|---|---|---|
| 3,121,534 | 2/1964 | Wilson | 239/4 X |
| 3,162,368 | 12/1964 | Choate et al. | 239/102 |
| 3,198,170 | 8/1965 | Onishi | 239/102.2 X |
| 3,400,892 | 9/1968 | Ensminger | 239/4 X |
| 3,966,120 | 6/1976 | Furgalus et al. | 239/102 |
| 4,153,201 | 5/1979 | Berger et al. | 239/4 |
| 4,193,009 | 3/1980 | Durley | 310/317 X |
| 4,319,155 | 3/1982 | Nakai et al. | 310/316 |
| 4,337,896 | 7/1982 | Berger et al. | 239/102 |
| 4,474,326 | 10/1984 | Takahashi | 239/102 |
| 4,492,338 | 1/1985 | Marelli | 239/124 X |
| 4,540,123 | 9/1985 | Junger | 239/102 |

OTHER PUBLICATIONS

"Ultrasonic Nozzles Take Pressure Out of Atomizing Processes", Harvey L. Berger; Sono Tek Corp., 9/84.

*Primary Examiner*—Andres Kashnikow
*Assistant Examiner*—Kevin Patrick Weldon
*Attorney, Agent, or Firm*—Lockwood, Alex, FitzGibbon & Cummings

[57] ABSTRACT

An ultrasonic spray nozzle includes a piezoelectric transducer which develops mechanical vibrations in response to an applied periodic electrical potential. The vibrations are mechanically amplified and propagate to an atomizing surface over which fluid to be atomized is discharged by an internal fluid passage. Maximum vibrational amplitude of the atomizing surface is achieved when the frequency of the applied electrical potential equals the natural resonant frequency of the nozzle. A parameter of the applied electrical potential, such as frequency, is periodically varied such that the vibrational amplitude of the atomizing surface is periodically increased and decreased. Fluid atomization is reduced during periods of reduced vibrational amplitude permitting fluid to be distributed with greater uniformity onto the atomizing surface. Such uniform distribution results in a significant improvement in the definition of the spray pattern produced by the nozzle during periods of increased vibrational amplitude. To further enhance uniform fluid distribution, auxiliary fluid passages are provided through the atomizing surface.

12 Claims, 9 Drawing Figures

FIG. 1
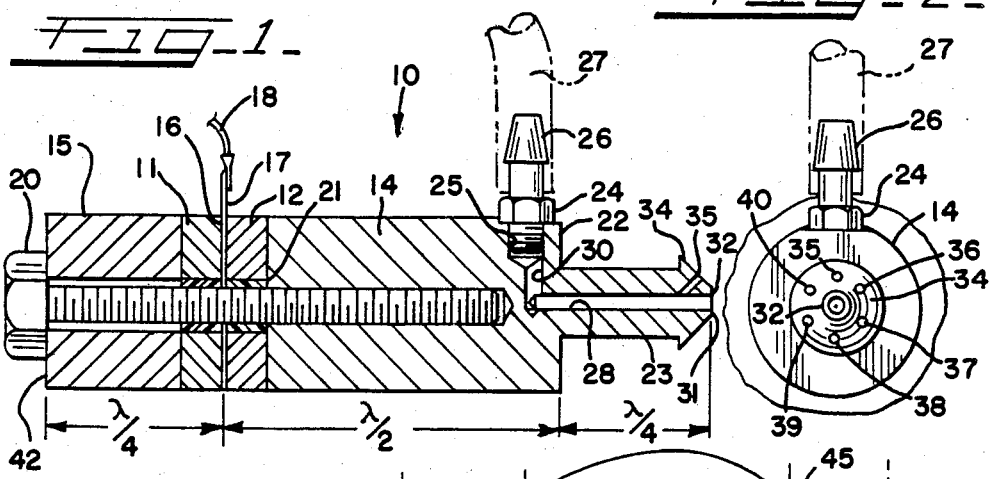
FIG. 2
FIG. 3
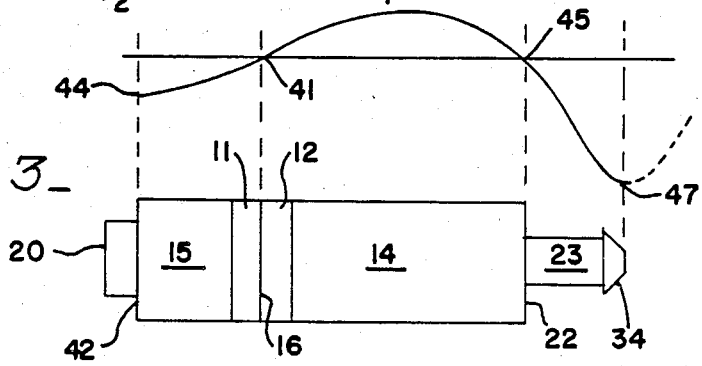
FIG. 4
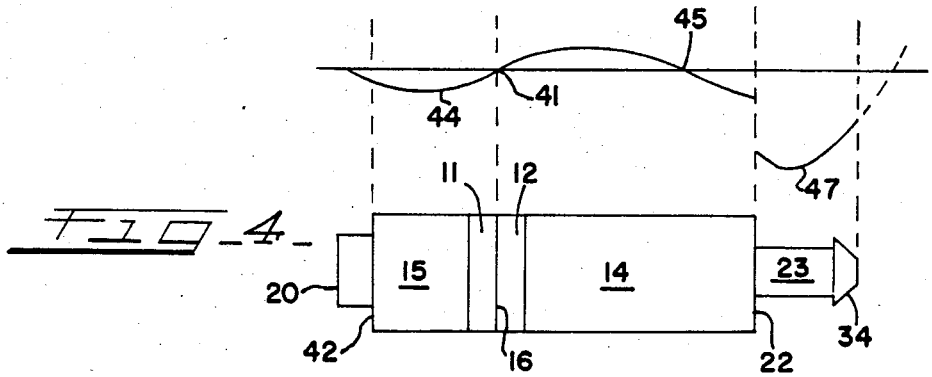
FIG. 5
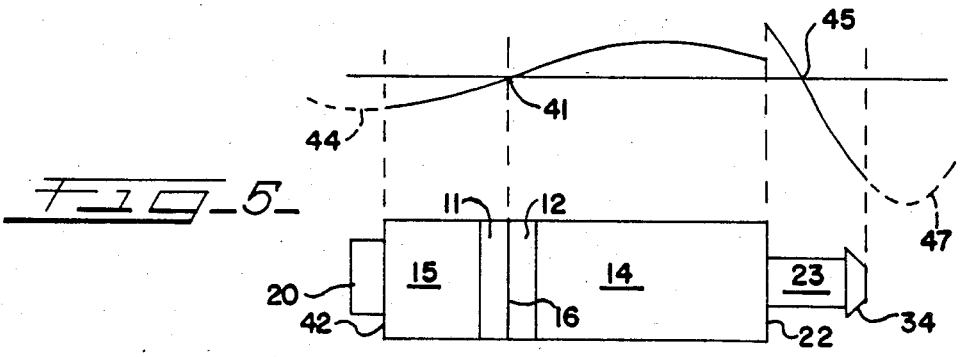

NOZZLE DRIVE GENERATOR
SPRAY ENABLE
GATE
MODULATOR
OSCILLATOR
CLASS B AMP.
REGULATED D.C. POWER SUPPLY
MODULATION WAVEFORM SIGNAL GENERATOR
FREQ. ADJUST
+V

ULTRASONIC SPRAY NOZZLE AND METHOD

BACKGROUND AND SUMMARY OF THE INVENTION

This invention relates generally to ultrasonic spray nozzles and in particular to an ultrasonic spray nozzle and method wherein drive energy to the nozzle is frequency modulated and wherein auxiliary fluid-flow ports are provided in the nozzle tip such that a well defined spray pattern is produced.

Ultrasonic nozzles which operate at a single drive frequency are well known and offer numerous advantages over conventional hydraulic and pneumatic spray nozzles. Typically, such ultrasonic nozzles provide reduced spray velocities, infinitely variable control of fluid spray rates and significantly reduced operating power consumption.

In contrast to conventional spraying mechanisms which rely on relatively high hydraulic pressures or high velocity gas streams for atomization of sprayed liquid media, ultrasonic nozzles utilize the ultrasonic mechanical vibrations of a piezoelectric transducer to vibrate an atomizing surface and thereby atomize a fluid disposed thereon. The absence of such pressures and gas streams results in the development of a droplet fog wherein the average velocity of individual droplets is very low compared to those produced by other atomizing techniques. Although a low average droplet velocity is of great benefit in that overspray and excess fluid delivery are both reduced, spray patterns made up of such low velocity droplets are often poorly defined. Accordingly, definite measures must be taken whenever the spray pattern shape provided by an ultrasonic nozzle is of importance.

One well-known technique for controlling the spray pattern of an ultrasonic nozzle involved entraining the spray droplets in a moving air stream and then shaping the air stream to provide the desired spray pattern. While this technique was effective, it had the disadvantage of requiring often complex, bulky, and expensive air blowers and related equipment.

Another well-known spray pattern control technique involved the use of a shaped atomizing surface in the construction of the ultrasonic nozzle. This technique was based on the principle that the individual droplets, produced when a uniform liquid film is atomized by an ultrasonically vibrating surface, will be thrown off in a perpendicular direction relative to the surface. Accordingly, the initial shape of the spray pattern produced by such an ultrasonic nozzle should, in theory, be related to the shape of the generating atomizing surface.

Although a properly shaped atomizing surface was found to advantageously influence the shape of the spray pattern it produced, it was found, in practice, that the pattern nevertheless tended to waver in space and become diffuse, particularly so in the region located more than a few inches from the atomizing surface. Such diffusion and wavering destroyed the definition of the spray pattern and resulted in areas of greater and lesser droplet concentrations along the spray pattern front. This, in turn, adversely affected the uniformity with which sprayed material could be deposited onto a substrate and was of particular significance in various processes, such as in the manufacture of pharmaceuticals, wherein it was desired to precisely deliver a known and minute quantity of material to a substrate so as to achieve a uniform concentration of the material therein.

Another difficulty associated with ultrasonic nozzles was the need to provide an independent drive source for each nozzle when two or more nozzles were to be operated simultaneously. Though the mechanical construction and operation of ultrasonic nozzles was greatly simplified over that of conventional hydraulic and pneumatic spraying mechanisms, effective ultrasonic nozzle operation was a result of careful design which sought to maximize the amplitude of the mechanical vibrations appearing on the nozzle atomizing surface. This was achieved by relating various nozzle dimensions to the vibrational wavelength provided when the nozzle was operated at a particular frequency. When properly designed, the natural resonant frequency of an ultrasonic nozzle would match that of an applied electrical drive potential and, ideally, would maximize the vibrational amplitude of the atomizing surface.

Although careful design and construction would result in a close match between the actual nozzle resonant frequency and the nominal design frequency, practical manufacturing tolerances, would, in most cases, reduce the probability of an exact correspondence between these frequencies. As a result, each nozzle, even though designed for operation at the same nominal operating frequency, would nevertheless have a particular, and in all likelihood, unique, operating frequency at which optimum performance was obtained. Accordingly, in use, the actual frequency of the nozzle drive signal was carefully adjusted to match the natural nozzle resonant frequency in order to obtain best results. This generally required that each nozzle of a multi-nozzle system be operated from its own dedicated energy source since the effort required to provide two or more perfectly matched nozzles far exceeded the savings to be realized in utilizing a single drive energy source.

The present invention is directed to an ultrasonic spray nozzle system and method wherein a parameter of the ultrasonic energy applied to the nozzle is varied with respect to time so as to result in a periodic increase and decrease in the vibrational amplitude of the nozzle's atomizing surface. This permits fluid to more uniformly cover the atomizing surface during periods of low vibrational amplitude and to thereafter be atomized into a well defined spray pattern during periods of increased vibrational amplitude. To further enhance the definition of the resulting spray pattern, the nozzle can be provided with one or more auxiliary fluid-flow ports which function to evenly distribute the fluid over the atomizing surface during periods of reduced vibrational amplitude.

In one principal aspect of the present invention, an ultrasonic nozzle includes a piezoelectric transducer which expands and contracts in response to an applied periodic electrical potential. The expansion and contraction of the piezoelectric transducer develops mechanical vibrations which appear on an atomizing surface formed on a portion of the nozzle. A parameter of the applied periodic electrical potential is modulated with time such that the vibrational amplitude of the atomizing surface is alternately increased and decreased.

In another principal aspect of the present invention, an ultrasonic nozzle, having an atomizing surface, includes a fluid passage which opens through the atomizing surface at a first location thereon. One or more auxiliary passages, which communicate with the main fluid passage, open through the atomizing surface at remote locations and function to communicate fluid to the atomizing surface such that the fluid is evenly distributed thereon.

In still another principal aspect of the present invention, the ultrasonic nozzle has a characteristic resonant frequency and the frequency of the applied drive energy is periodically varied from below to above the resonant frequency of the nozzle.

In still another principal aspect of the present invention, two or more ultrasonic nozzles are operated from a single source of drive energy. The drive energy frequency is modulated so as to periodically sweep through the resonant frequency of each nozzle. This assures that resonance is independently achieved in each nozzle over at least a portion of each frequency sweep cycle.

These and other objects, features, and advantages of the present invention will be clearly understood through consideration of the following detailed description.

BRIEF DESCRIPTION OF THE DRAWINGS

In the course of this description, reference will frequently made to the accompanying drawings in which:

FIG. 1 is a cross-sectional side view of an ultrasonic nozzle constructed in accordance with the present invention showing the principal elements thereof.

FIG. 2 is a front elevational view of the nozzle illustrated in FIG. 1 showing an arrangement of auxiliary fluid-flow passages which enhance fluid distribution over the nozzle's atomizing surface.

FIG. 3 is a graphical depiction of the amplitude and location of vibrational standing waves along the nozzle of FIG. 1 when the nozzle is operated at its natural resonant frequency.

FIG. 4 is a graphical representation, similar to FIG. 3, of the location and amplitude of standing waves along the nozzle when the nozzle is operated at a frequency above its resonant frequency.

FIG. 5 is a graphical representation, similar to FIG. 3, of the standing wave pattern resulting when the nozzle is operated below its resonant frequency.

DETAILED DESCRIPTION OF THE PREFERRED EMBODIMENT

Figures 6, 7, 8, 9:
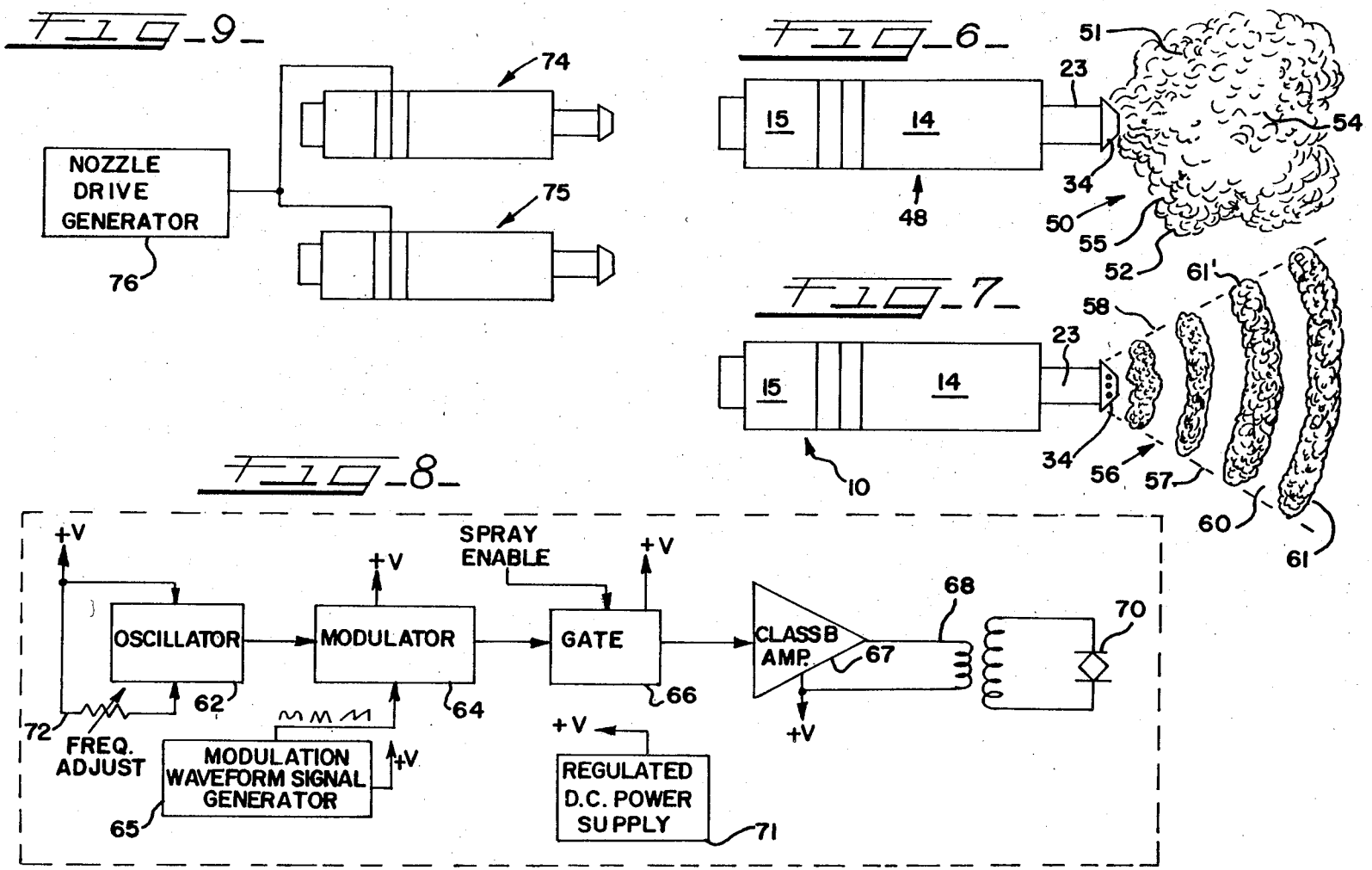
FIG. 6 is a side elevational view of an ultrasonic nozzle showing the spray pattern which results when neither auxiliary fluid-flow ports nor drive signal modulation are employed.
FIG. 7 is a side elevational view, similar to FIG. 6, showing the spray pattern which results when auxiliary fluid-flow ports and drive signal modulation are employed in accordance with the invention.
FIG. 8 is a simplified functional block diagram of an ultrasonic drive generator constructed in accordance with one aspect of the invention.
FIG. 9 is a simplified functional block diagram of a multi-nozzle ultrasonic spray system, constructed in accordance with one aspect of the invention, operable from a single source of ultrasonic drive energy.

Referring to the drawings, and in particular to FIGS. 1 and 2, an ultrasonic nozzle 10 constructed in accordance with the invention is illustrated. Nozzle 10 comprises a pair of disc-shaped piezoelectric transducer elements 11 and 12 mounted between a pair of generally cylindrical nozzle body members 14 and 15. An electrically conductive electrode disc 16 is positioned between the piezoelectric transducer elements and includes a projecting terminal 17 to which an electrical conductor 18 can be connected. A threaded bolt 20 extends through suitably dimensioned apertures formed in the rear nozzle body member 15, the piezoelectric transducer elements 11 and 12, and the electrode disc 16, and engages a threaded recess formed in the front nozzle body member 14 as illustrated. When tightened, bolt 20 serves to join each of these elements to form a unitary nozzle structure. A cylindrical insulating sleeve 21 is disposed around a segment of the threaded portion 22 of bolt 20 in the vicinity of the piezoelectric transducer elements as shown and functions to electrically isolate the bolt from the transducer elements and the electrode disc.

The arrangement of the piezoelectric transducer elements, the nozzle body members and the electrode disc is such that each transducer element is in contact with the electrode disc on one side and in contact with a nozzle body member on the other. In addition to mechanically joining the nozzle components as shown, bolt 20 also serves to electrically connect the front nozzle body member 14 with rear nozzle body member 15. Accordingly, an electrical potential, applied between the electrode terminal 17 and either of the nozzle body members, will appear across each of the piezoelectric transducer elements 11 and 12. The cut, orientation and polarization of the piezoelectric transducer elements is such that each element expands across its thickness when the potential applied to electrode disc 16 is of one polarity, and contracts when the potential applied to the electrode disc is of opposite polarity. Accordingly, the application of a periodic electrical potential between conductor 18 and either of the nozzle body members 14 or 15 will result in the development of longitudinal mechanical vibrations at the frequency of the periodic potential. Such vibrations propagate longitudinally along the ultrasonic nozzle.

In accordance with conventional practice, each of the nozzle body members 14 and 15 is formed of an electrically and acoustically conductive material such as aluminum, magnesium, or titanium, and is of generally circular cross-section. Each nozzle is designed for operation at a particular nominal operating frequency which, in turn, determines the wavelength of the mechanical vibrations. In further accordance with conventional practice, best operation is obtained when the length of the rear nozzle body member 15 is made equal to $\frac{1}{4}$ wavelength at the nominal operating frequency while the overall length of the front nozzle body member 14 is made equal to $\frac{3}{4}$ wavelength. Preferably, the diameter of each nozzle body member is less than $\frac{1}{4}$ wavelength at the nominal operating frequency.

In further accordance with conventional practice, the diameter of the forward $\frac{1}{4}$ wavelength portion of the front nozzle body member 14 is reduced to form an amplifying transition 22 and a reduced diameter nozzle stem 23 as illustrated. The reduction in diameter at the amplifying transition provides significant mechanical amplification of the longitudinal vibrations produced by the piezoelectric transducer elements. The amplification factor is equal to the ratio of cross-sectional area of the front nozzle body member 14 and the nozzle stem 23 and in practice typically ranges between 2 and 10.

Adjacent transition 22, the front nozzle body member 14 includes a threaded fluid fitting 24 which is received in a threaded recess 25 formed in its upper surface. Fluid fitting 24 includes a upwardly projecting nipple 26 which permits connection to a flexible fluid conduit 27 in known manner. A main fluid passage 28 is bored along the longitudinal axis of the nozzle stem 23 and communicates with fluid fitting 24 through a short passage 30 bored through the bottom of recess 25. Opposite the short passage 30, the main fluid flow passage 28 opens through the nozzle stem 23 at the distal end 31 thereof. Passage 28 thereby forms an opening 32 through which fluid from fluid conduit 27 can be discharged.

Adjacent end 31, the nozzle stem 23 includes a frustoconical atomizing surface 34 which tapers such that it is narrowest adjacent end 31 of the nozzle stem. In accordance with one principal aspect of the present invention, a plurality of auxiliary fluid-flow passages 35, 36, 37, 38, 39 and 40 are formed in the nozzle stem 23 adjacent end 31 thereof and open through the atomizing surface 34 at equally spaced points thereon which are remote from the main fluid passage opening 32. Each auxiliary passage communicates with the main fluid passage 28 and extends in a generally radial direction therefrom. Preferably, each auxiliary passage is also oriented perpendicularly to the atomizing surface 34 and shown, as is of smaller diameter than the main fluid passage 28.

In operation, a periodic electrical drive signal is applied to the ultrasonic nozzle 10 through conductor 18 and the nozzle body members 14 and 15 resulting in the development of longitudinal mechanical vibrations. When the frequency of the drive signal is substantially equal to the nominal operating frequency of the nozzle, the amplitude of these vibrations is amplified and is maximum along the atomizing surface 34. Through a combination of hydraulic pressure and capillary action, fluid supplied to ultrasonic nozzle 10 through fluid conduit 27 flows outwardly through main fluid passage 28 and auxiliary passages 35–40 so as to form a fluid film on the atomizing surface 34. By reason of the amplified ultrasonic vibrations appearing on the atomizing surface, this film is rapidly transformed into a multitude of small droplets which form a fog adjacent the nozzle stem end 31.

In further accordance with another principal aspect of the invention, the drive energy applied to the ultrasonic nozzle 10 is not uniform but rather is modulated such that the vibrational amplitude of the atomizing surface 34 is periodically reduced and increased with respect to time. This is achieved through modulation of at least one parameter of the periodic drive signal applied to the nozzle. The resulting periodic increase and decrease in the vibrational amplitude appearing on the atomizing surface results in improved spray pattern definition and freedom from clogging.

FIG. 3 depicts the vibrational standing wave pattern which results when the ultrasonic nozzle is operated at its actual resonant frequency. Since the piezoelectric transducer elements expand or contract equally on either side of the electrode disc 16, the vibrational amplitude will at all times be at a minimum at the plane defined by the electrode. Thus, a node, or vibrational minimum 41, appears at the plane of the electrode disc. Since the rear-most surface 42 of the rear nozzle body member 15 is spaced $\frac{1}{4}$ wavelength from the electrode disc, an antinode, or vibrational maximum 44, appears at the rear of the nozzle. The distance between the electrode disc 16 and the amplifying transition 22 is equal to $\frac{1}{2}$ wave length and accordingly, another node 45 appears at the transition. The distal end 31 of the nozzle stem 23 is spaced $\frac{1}{4}$ wavelength beyond the transition and, accordingly, a vibrational maximum 47 appears on the atomizing surface 34. As described earlier, the reduced diameter of the nozzle stem 23, causes the vibrational maximum 47 to be increased by the appropriate gain factor. Since a vibrational maximum is located on the atomizing surface, maximum atomization occurs when the nozzle is operated at its natural resonant frequency.

FIG. 4 illustrates the standing wave pattern which results when the nozzle is operated at a frequency greater than its natural resonant frequency. As in the case of operation at the actual resonant frequency, node 41 will remain located in the plane of the electrode disc 16. However, the relative length of the rear nozzle body member 15 is now greater than $\frac{1}{4}$ wavelength. Accordingly, antinode 44 will no longer be located at the rear surface 42 of the nozzle but, rather, will be displaced toward the electrode disc as shown. Similarly, node 45 will be displaced from transition 22 toward electrode disc 16. Antinode 47 will also be displaced toward the electrode disc as shown with the result that the vibrational amplitude appearing on the atomizing surface 34 is significantly reduced.

FIG. 5 illustrates the standing wave pattern which results when the ultrasonic nozzle is operated at a frequency lower than its actual resonant frequency. Again, node 41 is located in the plane of the electrode disc 16. As the length of the rear nozzle body member 15 is now less than $\frac{1}{4}$ wavelength, antinode 44 is displaced beyond the rear surface 42 of the nozzle in a direction away from the electrode disc. Similarly, node 45 is displaced beyond transition 22 in a direction away from electrode disc 16. This has the effect of displacing the vibrational maximum 47 beyond the end 31 of the atomizing surface 34 with the result that the vibrational amplitude of the atomizing surface is significantly reduced. Thus, it is seen that any shift of the drive signal frequency from the actual resonant frequency of the nozzle will result in a decrease in the amplitude of vibrations appearing on the atomizing surface. Accordingly, periodic modulation of the drive signal about the nozzle resonant frequency will result in a periodic increase and decrease in the vibrational amplitude as antinode 47 periodically traverses the atomizing surface.

The beneficial results which are obtained when the vibrational amplitude of the atomizing surface is periodically increased and decreased can be observed with reference to FIGS. 6 and 7. FIG. 6 depicts the spray pattern which results when an ultrasonic nozzle 48, otherwise identical to nozzle 10, is operated at a single constant drive frequency and is not provided with the auxiliary passages 35–40. As shown, the spray pattern 50 of such a nozzle lacks clear definition, particularly along its side margins 51 and 52, and includes randomly located areas 54 and 55 of reduced and increased droplet concentrations respectively.

FIG. 7 illustrates the spray pattern which results when an ultrasonic nozzle 10, otherwise identical with nozzle 48 illustrated in FIG. 6, is provided with auxiliary passages 35–40 and is operated such that the vibrational amplitude on the atomizing surface is periodically increased and reduced. As shown, the resulting spray pattern 56 is much more clearly defined than is pattern 50, particularly so along the side margins 57 and 58 which, in the embodiment illustrated, clearly define a conical form. Rather than the randomly located areas of reduced and increased droplet concentration shown in FIG. 6, pattern 56 includes distinct areas 60 and 61 of reduced and increased droplet concentration which are uniformly developed along spherically expanding wavefronts at regularly spaced intervals as shown. Although droplet concentrations differ in areas 61 and 61', the concentrations remain constant across the area of each wavefront. Accordingly, sprayed material is uniformly deposited by spray pattern 56.

The areas of increased droplet concentration are formed during periods of maximum vibrational amplitude on the atomizing surface, and the areas of reduced droplet concentration are formed during periods of reduced vibrational amplitude. Accordingly, the spacing between the areas of reduced and increased droplet concentration is determined by the rate at which the vibrational amplitude of the atomizing surface is increased and reduced. When such variation of the vibrational amplitude is achieved through frequency modulation of the applied drive signal, the spacing of the reduced and increased droplet concentration areas is influenced by the maximum frequency deviation of the applied drive signal as well as the deviation rate.

It has been observed that when a uniform film is atomized by means of an ultrasonically vibrating underlying surface, the resulting droplets are thrown off in a direction perpendicular thereto. Thus, a frusto-conical atomizing surface should, for example, produce a generally cone-shaped spray pattern. Prior to the present invention however, the expected correlation between the shape of an atomizing surface and the spray pattern it produces has not been observed in actual practice. It is hypothesized that the reason for this discrepancy is that fluid is not uniformly distributed over the atomizing surface when a single outlet port is utilized in conjunction with a constant vibrational amplitude. In such a case, the fluid film tends to be thicker adjacent the single outlet port than at locations spaced therefrom and, accordingly, the resulting pattern deviates from that expected when a uniform film thickness is maintained.

It is believed that the improvement in spray pattern definition provided by the present invention results from the maintenance of a substantially uniform fluid film on the atomizing surface during fluid atomization. During periods of reduced vibrational amplitude, it is believed that the rate of fluid atomization is considerably reduced and, therefore, fluid discharged from the fluid discharge opening 32 has an opportunity to become evenly distributed over the atomizing surface in a substantially uniform film. During the immediately following period of increased vibrational amplitude, the uniform film is substantially atomized and, by virtue of its uniformity, more closely approximates the theoretical atomization model, with the further result that the atomization droplets more closely follow the predicted perpendicular flight path. This in turn improves the spray pattern definition. The provision of one or more auxiliary fluid-flow passages also contributes to the uniform distribution of fluid onto the atomizing surface during periods of reduced vibrational amplitude and thus also contributes to improved spray pattern definition. Both modulation of the nozzle drive signal and the provision of auxiliary fluid passages each contribute to an improvement in the spray pattern definition and uniformity, though either alone will independently provide some improvement.

A further advantage of the auxiliary fluid-flow passages is that, in contrast to prior nozzles, fluid cavitation within the fluid-flow passage 28 is not a problem to be avoided, but, rather, is of benefit in that it tends to promote fluid flow through the auxiliary passages and thereby improve the distribution of fluid over the atomizing surface. Accordingly, the need for decoupling sleeves within the fluid-flow passage 28 is eliminated. A further advantage of modulating the drive energy is that the formation of large droplets on the atomizing surface, which may tend to clog the nozzle, is avoided since local cavitation on the atomizing surface is reduced, if not eliminated, during periods of reduced vibrational amplitude.

It will be appreciated that while frequency modulation of the applied nozzle drive signal has been described, the desired variation in the vibrational amplitude appearing on the atomizing surface can also be achieved through amplitude modulation of the applied drive signal. This however requires that the unchanging frequency of the applied drive signal be closely matched to the resonant frequency of the nozzle in order to assure that the maximum vibrational amplitude appearing on the atomizing surface is sufficient to cause fluid atomization. When frequency modulation is employed, such frequency matching is not as critical since effective atomization will occur provided the frequency deviation is such that the drive signal frequency is swept through the nozzle resonant frequency at some point during its excursions.

FIG. 8 is a simplified functional block diagram of an electrical drive signal supply circuit suitable for use with the ultrasonic nozzle described herein. The drive circuit includes an oscillator 62 which develops a periodic electrical voltage in the ultrasonic frequency range (20 kHz to 100 kHz). The output of oscillator 62 is applied to an input of a modulator circuit 64 of known construction which, in the embodiment illustrated, modulates the frequency of the applied ultrasonic voltage. A modulation waveform signal generator 65 develops a modulating signal which, when applied to modulator 64 modulates the ultrasonic oscillator voltage in accordance therewith. The modulated output of modulator 64 is applied through a voltage controlled gate 66 to the input of a class-B power amplifier 67. Gate 64 responds to an applied control signal and functions to selectively enable or disable the nozzle. The output of power amplifier 67 is coupled through a transformer 68 to the piezoelectric element 70 of an ultrasonic nozzle in order to achieve the required operating voltages (approximately 400 volts). A regulated DC power supply 71 is provided for energizing the ultrasonic drive generator circuitry. Additionally, a variable resistance 72 is connected between the supply voltage and oscillator 62 to permit user adjustment of the oscillator frequency.

The modulation waveform signal generator 65 functions to generate the signal with which the oscillator voltage is modulated and therefore determines the frequency excursions of the frequency modulated drive signal applied to ultrasonic nozzle. The waveform produced by generator 65 can be selected in accordance with the desired characteristics of the ultrasonic nozzle and can, for, example comprise a triangular, sawtooth or sinusoidal waveform. Typically, satisfactory operation is achieved with modulating signal frequencies between 20 Hz and 5000 Hz, with a maximum frequency deviation of between 200 Hz and 400 Hz. While these frequencies have been found to be satisfactory in actual practice, they are not to be considered limiting and satisfactory operation can be obtained at frequencies other than those specified.

A further advantage which results when the drive signal to an ultrasonic nozzle is frequency modulated is that two or more imperfectly matched ultrasonic nozzles 74 and 75 can be operated from a single, frequency-modulated drive signal generator 76 as illustrated in FIG. 9. Even though the natural resonant frequency of nozzles 74 and 75 may differ by several hundred Hz, satisfactory operation can be obtained provided the maximum frequency deviation is sufficient to assure that the drive signal frequency equals each of the nozzle resonant frequencies at some point during its excursions. Such deviation can be readily achieved, and the need for a dedicated drive signal generator in association with each nozzle, or, in the alternative, careful matching between nozzles, is not required for satisfactory operation of each nozzle. Accordingly, a substantial saving in the cost of a multi-nozzle system can be realized.

While a particular embodiment of the invention has been shown and described, it will be appreciated that variations can be made without departing from the scope of the invention in its broader aspects. For example, as previously noted, an improvement in spray pattern definition can result from either frequency or amplitude modulation of the applied drive signal energy. Furthermore, the number, size and location of the auxiliary fluid-flow ports is not critical provided they are arranged so as to promote the formation of uniform fluid film on the atomizing surface. In some embodiments, it may be advantageous to omit the auxiliary ports altogether. It is also noted that while a frusto-conical atomizing surface has been shown and described, the invention is readily adaptable to nozzles having other atomizing surface shapes and configurations. Finally, while specific modulating waveforms, frequencies and frequency deviations have been described, satisfactory operation can be obtain using values other than those specified.

While a particular embodiment of the invention has been shown and described, it will be obvious to those skilled in the art that changes and modifications may be made without departing from invention in its broader aspects, and, therefore, the aim in the appended claims is to cover all such changes and modification as fall within the true spirit and scope of the invention.

We claim:

1. In an ultrasonic nozzle of the type wherein a piezoelectric transducer expands and contracts in response to an applied periodic electrical potential so as to develop a plurality of mechanical vibrations on an atomizing surface, the improvement which comprises means for modulating the frequency of the applied periodic electrical potential with respect to time so as to periodically vary the amplitude of the vibrations on the atomizing surface.

2. The improvement as defined in claim 1, wherein the ultrasonic nozzle has a characteristic resonant frequency and the frequency of the applied periodic electrical potential varies from above to below the characteristic resonant frequency.

3. The improvement as defined in claim 1, wherein the frequency of the applied periodic electrical potential is varied such that the vibrations on the atomizing surface vary between a maximum amplitude at which fluid atomization readily takes place and a minimum amplitude at which fluid atomization is substantially reduced.

4. An ultrasonic nozzle for atomizing liquids comprising:

an atomizing surface;

means responsive to an applied periodic electrical potential for vibrating said atomizing surface to atomize the liquid when the liquid is disposed thereon;

fluid passage means for communicating the liquid to said atomizing surface, said fluid passage means including a main passage opening through said atomizing surface at a first location thereon and an auxiliary passage communicating with said main passage and opening through said atomizing surface at a second location remote from said first location, whereby fluid is communicated through said main and auxiliary passages for substantially uniform distribution onto said atomizing surface; and generating means for generating and applying said periodic electrical potential to said vibrating means, said generating means periodically modulating the frequency of said periodic electrical potential with respect to time such that the amplitude of vibrations on said atomizing surface are periodically increased and decreased.

5. An ultrasonic nozzle as defined in claim 4, wherein said ultrasonic nozzle includes an elongate nozzle stem and said fluid passage extends along the longitudinal axis of said fluid stem.

6. An ultrasonic nozzle as defined in claim 5, wherein said atomizing surface is disposed adjacent an end of said elongate nozzle stem and said main passage opens through said atomizing surface adjacent the center thereof.

7. An ultrasonic nozzle as defined in claim 6, wherein said nozzle includes a plurality of said auxiliary passages extending generally radially from said main passage and opening through said atomizing surface.

8. An ultrasonic nozzle for atomizing a liquid conveyed thereto comprising:

transducer means for developing a series of mechanical vibrations in response to an applied periodic electrical potential;

mechanical amplification means, coupled to said transducer means, for amplifying said mechanical vibrations, said amplifying means having an atomizing surface on which said amplified mechanical vibrations appear;

fluid passage means for conveying fluid onto said atomizing surface for atomization by said amplified mechanical vibrations; and drive means for developing and applying said periodic electrical potential to said transducer means, said drive means periodically varying the frequency of said periodic potential so as to periodically vary the amplitude of said amplified mechanical vibrations appearing on said atomizing surface, said amplitude variation being such that the liquid from said fluid passage means flows over said atomizing surface during periods of reduced vibrational amplitude and is atomized during periods of increased vibrational amplitude.

9. An ultrasonic nozzle as defined in claim 8, wherein said transducer means include a piezoelectric element.

10. An ultrasonic nozzle as defined in claim 9, wherein said amplifying means comprise a generally cylindrical member having a first portion of relatively greater diameter in contact with said transducer means and a portion of relatively lesser diameter opposite said transducer means.

11. An ultrasonic nozzle as defined in claim 10, wherein said fluid passage means include a main fluid passage opening through said atomizing surface at a first location thereon and auxiliary fluid passage coupled to said main fluid passage and opening through said atomizing surface at a second, remote location thereon.

12. A method for operating an ultrasonic nozzle of the type wherein mechanical vibrations are produced in response to an applied periodic electrical potential and appear on an atomizing surface, comprising the step of:

periodically varying the frequency with respect to time of the applied periodic electrical potential so as to periodically vary the amplitude of the vibrations appearing on the atomizing surface.

* * * * *

UNITED STATES PATENT AND TRADEMARK OFFICE

CERTIFICATE OF CORRECTION

PATENT NO. : 4,659,014

DATED : April 21, 1987

INVENTOR(S) : J. Michael Soth and James R. Klemm

It is certified that error appears in the above-identified patent and that said Letters Patent is hereby corrected as shown below:

Column 4, line 62, delete "area" and insert —areas--.
Column 5, line 24, delete "and" and insert —as--.
Column 5, line 24, delete "as" and insert —and—.

Signed and Sealed this

Fifteenth Day of September, 1987

*Attest:*

DONALD J. QUIGG

*Attesting Officer*

*Commissioner of Patents and Trademarks*